US006582183B2

(12) United States Patent
Eveker et al.

(10) Patent No.: US 6,582,183 B2
(45) Date of Patent: Jun. 24, 2003

(54) METHOD AND SYSTEM OF FLUTTER CONTROL FOR ROTARY COMPRESSION SYSTEMS

(75) Inventors: Kevin M. Eveker, Alexandria, VA (US); Daniel L. Gysling, Glastonbury, CT (US); Carl N. Nett, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 105 days.

(21) Appl. No.: 09/789,151

(22) Filed: Feb. 20, 2001

(65) Prior Publication Data

US 2003/0077163 A1 Apr. 24, 2003

Related U.S. Application Data

(60) Provisional application No. 60/215,244, filed on Jun. 30, 2000.

(51) Int. Cl.[7] ..... F01D 25/06

(52) U.S. Cl. ..... 415/1; 415/119

(58) Field of Search ..... 415/1, 119, 14, 415/26, 28, 48, 49, 17

(56) References Cited

U.S. PATENT DOCUMENTS

| | | | | |
|---|---|---|---|---|
| 4,118,926 A | | 10/1978 | Curvino et al. | 60/39.06 |
| 4,550,564 A | | 11/1985 | Stryker et al. | 60/39.093 |
| 4,581,888 A | | 4/1986 | Schmitzer et al. | 60/39.091 |
| 4,622,808 A | | 11/1986 | Kenison et al. | 60/39.29 |
| 4,967,550 A | | 11/1990 | Acton et al. | 60/39.29 |
| 5,051,918 A | | 9/1991 | Parsons | 364/494 |
| 5,141,391 A | * | 8/1992 | Acton et al. | 415/119 |
| 5,165,844 A | | 11/1992 | Khalid | 415/17 |
| 5,165,845 A | | 11/1992 | Kahlid | 415/17 |
| 5,269,136 A | | 12/1993 | Khalid | 60/204 |
| 5,275,528 A | | 1/1994 | Freeman et al. | 415/1 |
| 5,375,412 A | | 12/1994 | Khalid et al. | 60/39.29 |
| 5,448,881 A | | 9/1995 | Patterson et al. | 60/39.29 |
| 5,517,852 A | | 5/1996 | Woodason et al. | 73/117.4 |
| 5,541,857 A | | 7/1996 | Walter et al. | 364/558 |
| 5,594,665 A | | 1/1997 | Walter et al. | 364/558 |
| 5,726,891 A | | 3/1998 | Sisson et al. | 364/431.02 |

FOREIGN PATENT DOCUMENTS

| | | | |
|---|---|---|---|
| WO | WO 97/00381 | 1/1997 | F04D/27/02 |

* cited by examiner

*Primary Examiner*—Edward K. Look
*Assistant Examiner*—Kimya N McCoy
(74) *Attorney, Agent, or Firm*—Bachman & LaPointe, P.C.

(57) ABSTRACT

The invention is a method and system for fan flutter control. The output of circumferentially distributed sensors is used to calculate the asymmetry of a flow field. The asymmetry measurement is used to modulate a bleed valve, variable exhaust nozzle or other device to increase the fan's tolerance of flutter disturbances.

16 Claims, 7 Drawing Sheets

METHOD AND SYSTEM OF FLUTTER CONTROL FOR ROTARY COMPRESSION SYSTEMS

CROSS-REFERENCE TO RELATED APPLICATIONS

This patent relates to and claims priority to U.S. Provisional Patent Application No. 60/215,244, filed on Jun. 30, 2000. That Provisional Patent Application is incorporated by reference in its entirety herein.

BACKGROUND OF THE INVENTION

1. Field of the Invention

This invention relates generally to a method and system for controlling aeromechanical instabilities (flutter) in rotary compression systems such as aircraft gas turbine engines. More particularly, this invention relates to sensing rotary blade characteristics of a rotary compressor or the flow asymmetry produced by blade movement to minimize flutter instability conditions.

2. Brief Description of the Art

Flutter is aeromechanical instability that is experienced near the stall line of a performance map due to blade motion.

Flutter imposes constraints on the performance of rotary compressors, such as gas turbine engines. Flutter is caused by blade motion or deflection and can be viewed as a two-dimensional phenomena that results in a region of reduced or reversed fluid flow through the compressor causing the compressor to reduce output. Flutter instability can degrade the performance of the rotary compressor and may also lead to fatigue failure or other permanent damage to the compressor. One result of the flutter instability can be blade deformation and/or blade fatigue failure. Thus, it is desirable to avoid rotary compressor blade motion that causes flutter.

One possible solution to reduce the effects of flutter in a rotary compressor is to lower the operating line of the compressor by shutting down the compressor and restarting it. Unfortunately, this results in substantial performance penalties for the compressor.

Thus, what is needed to solve flutter instability, encountered by rotary compressors, is a technique to optimize performance while avoiding flutter disturbances. A solution to eliminating stall and/or surge is disclosed in WO Patent Application Serial No. 9700381, with a priority date of Nov. 2, 1995 entitled, "Compressor Stall and Surge Control Using Airflow Asymmetry Measurement", which is hereby incorporated herein by reference in its entirety. The stall and/or surge approach in the above-cited patent application does not solve the problem of flutter instability. Flutter is distinguished from rotating stall and surge because rotating stall and surge occurs without mechanical motion, while flutter is a function of blade motion. The blade movement, and associated deformation or deflection of the blade is the source of flutter instability. Stall and surge are aerodynamic instabilities resulting from a compressor operating in excess of its rated capacity.

Another example of the control of unsteady motion phenomena may be found in U.S. Pat. No. 4,967,550 entitled "Active Control of Unsteady Motion Phenomena in Turbomachinery" which is hereby incorporated herein by reference in its entirety. The aforementioned U.S. Patent describes a control system for actively controlling at least one mode of unsteady motion phenomena in turbomachinery in order to increase the operating range of the turbomachinery.

BRIEF SUMMARY OF THE INVENTION

One advantage of the present invention is to provide a control system that facilitates operation of a rotary compressor at an optimal operating mode, while avoiding the flutter instability characteristics.

Accordingly, one aspect of the instant invention is drawn to a system for reducing flutter instabilities in a rotary compressor having a plurality of blades that comprises a system for reducing flutter characteristics in a rotary compressor having a plurality of blades comprising:

- a plurality of sensors for sensing vibrations resulting from deformation movement of the blade and generating a flutter signal that is a function of the vibrations;
- a signal conditioning circuit, coupled to each of the sensors for receiving the flutter signals and processing the flutter signals to produce a composite signal that is a function of the flutter signals;
- a computation circuit, coupled to the signal conditioning circuit, for receiving the composite signal and generating an amplitude signal that is a function of the composite signal;
- a flutter control circuit, coupled to the computation circuit, for receiving the amplitude signal and generating a control signal that is a function of the amplitude signal;
- an actuator, coupled to the flutter control circuit, for receiving the control signal and responding to the control signal by modulating an annulus averaged flow through the compressor thereby reducing flutter characteristics on the plurality of blades.

A second aspect of the instant invention is a process for reducing flutter in a rotary compressor system that comprises a method for reducing flutter characteristics in a rotary compression system comprising:

- sensing vibration produced by a rotating blade;
- generating a flutter signal that is a function of the sensed vibration;
- transmitting the flutter signal to a processor;
- generating a control signal based on the flutter signal; and transmitting the control signal to an actuator for controlling the position of the actuator, thereby modulating an annulus averaged flow through the compressor.

A third aspect of the instant invention is drawn to a method for reducing flutter instability of a rotary compressor wherein the steps of the method are stored on a computer-readable medium and comprise a method for reducing instability of a rotary compressor stored on a computer-readable medium comprising:

- generating a substantially parabolic flutter boundary curve representing flutter parameters of the rotary compressor;
- operating the rotary compressor in a substantially linear mode of operation that is in accordance with substantially optimum operating parameters of the rotary compressor;
- sensing flutter vibrations of the compressor;
- calculating a differential quantity representative of the difference between the flutter boundary curve and the operating mode;
- comparing the flutter vibrations to the differential quantity;
- operating the rotary compressor in a substantially nonlinear mode of operation when the magnitude of the flutter vibration is greater than the differential quantity;

monitoring the relationship of the magnitude of the flutter vibration and the differential quantity; and operating the rotary compressor in the substantially linear mode of operation when the flutter vibration is less than the differential quantity.

BRIEF DESCRIPTION OF THE DRAWINGS

A more complete understanding of the instant invention and the attendant features and advantages thereof may be had by reference to the following detailed description of the invention when considered in conjunction with the accompanying drawings wherein.

DETAILED DESCRIPTION OF THE PREFERRED EMBODIMENTS OF THE INVENTION

Figure 1:
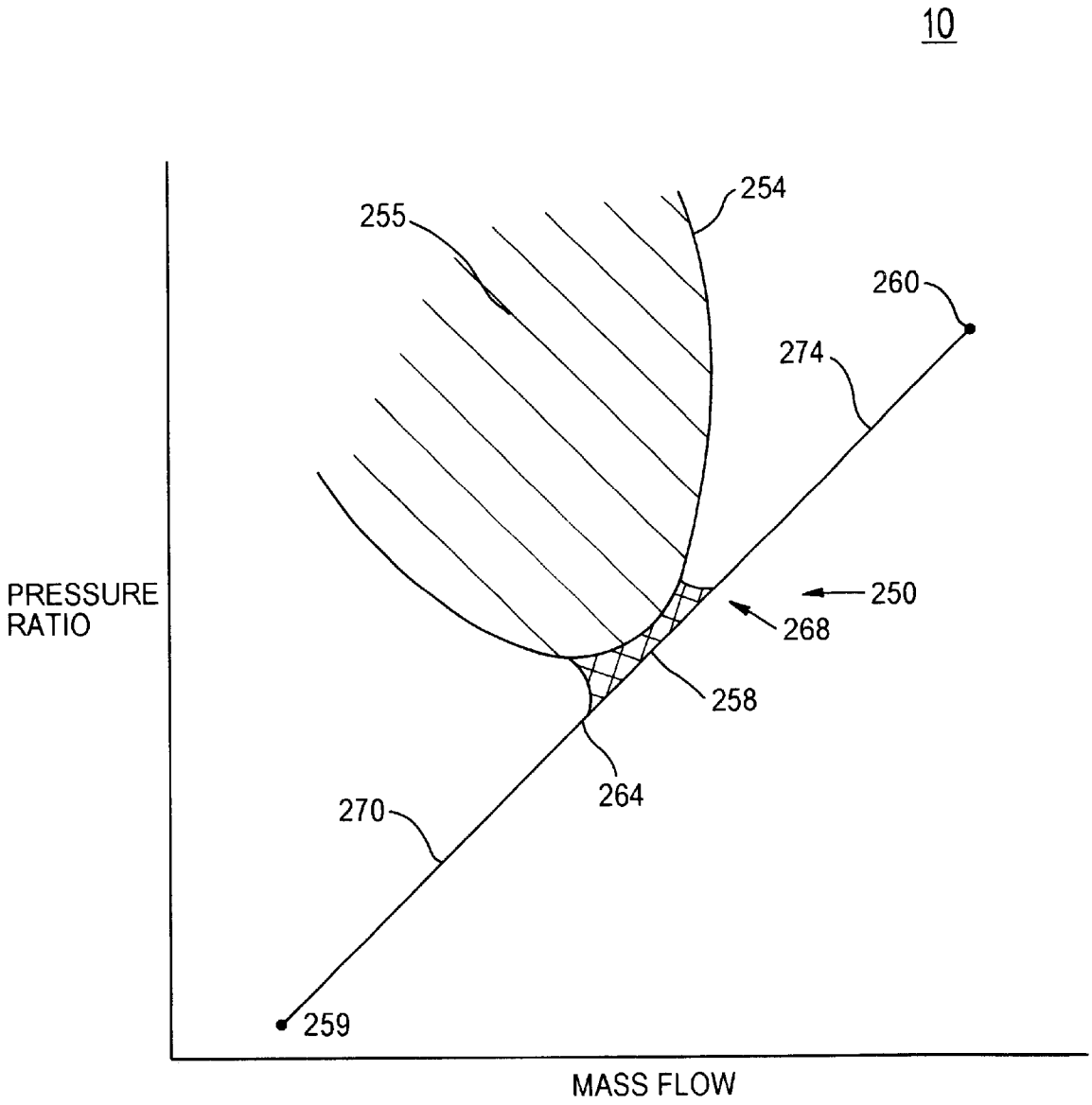
FIG. 1 shows a diagram of a performance map of a rotary compressor.

FIG. 1 shows an example of a performance map 10 for a rotary compression system. Although this invention will be described in terms of a rotary compressor for a gas turbine engine, that is suitably mounted to a vehicle, such as an aircraft, it also is equally applicable to other rotary compressors and similar apparatus such as axial flow compressors, industrial fans, centrifugal compressors, centrifugal chillers, and blowers.

The performance map 10 plots mass flow on the X-axis and pressure ratio on the Y-axis. Mass flow is the rate of fluid passing through a compressor per unit time. Pressure ratio is the pressure at the exit nozzle of a compressor divided by the pressure at the inlet of a compressor. The performance map 10 shows an operating line 250 that represents nearly optimal operational characteristics or parameters for a particular rotary compressor. Point 260 on operating line 250 suitably represents a "take off" point, which means the pressure ratio and mass flow relationship is such that the compressor provides sufficient thrust to a vehicle (such as an aircraft) to which the compressor is mounted to enable liftoff of the vehicle. The operating line 250 is also known as the annulus average mass flow. The operating line 250 is substantially linear from its origin 259 to take off point 260.

Flutter boundary region 255 is bounded by the substantially parabolic curve 254. The flutter boundary region 255 is an area of performance instability that degrades the performance of the compressor and may lead to permanent and/or catastrophic damage to one or more blades of the compressor. Therefore, preventing the operating line 250 from intersecting the flutter boundary region 255 as delineated by parabolic curve 254 is preferred, thereby avoiding undesired flutter characteristics. The region shown as area 258 illustrates a region that could possibly introduce flutter instability in the rotary compressor because of the approximately asymptotic relationship of operating line 250 to the flutter boundary region 255. The area 258 is a differential quantity ($\partial$) between the flutter boundary region 255 and optimum operating conditions. Thus, when the operating line 250 reaches point 264, as sensed by sensors, the instant invention controls an actuator to alter the mass flow characteristics of the rotary compressor. The compressor operates in a transient mode of operation until the sensors provide signals indicative of an acceptable level of blade instability.

Thus, the rotary compressor can operate in a substantially linear mode of operation during the portion of the operating line 250 shown as portion 270 since the flutter vibrations will not introduce any detrimental effects. At point 264, the rotary compressor operates in a substantially non-linear mode of operation which means that the area of the exit nozzle of a compressor is modified to change the annulus averaged mass flow. At point 268, the rotary compressor can once again operate in a substantially linear mode of operation, shown as section 274 of operating line 250.

Figure 2A:
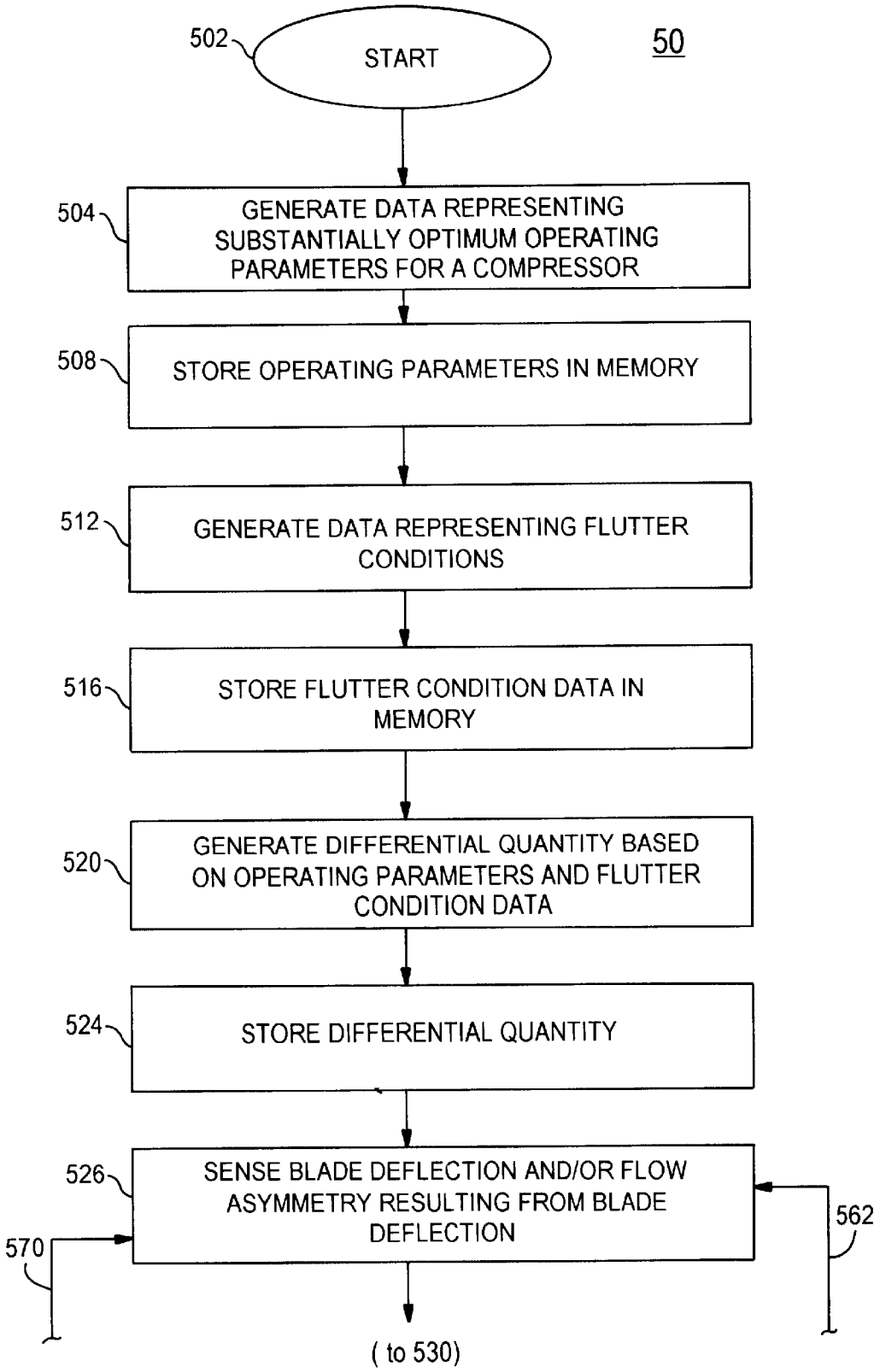
FIGS. 2A and 2B show a flow chart for generating a flutter-reducing control signal.
Figure 2B:
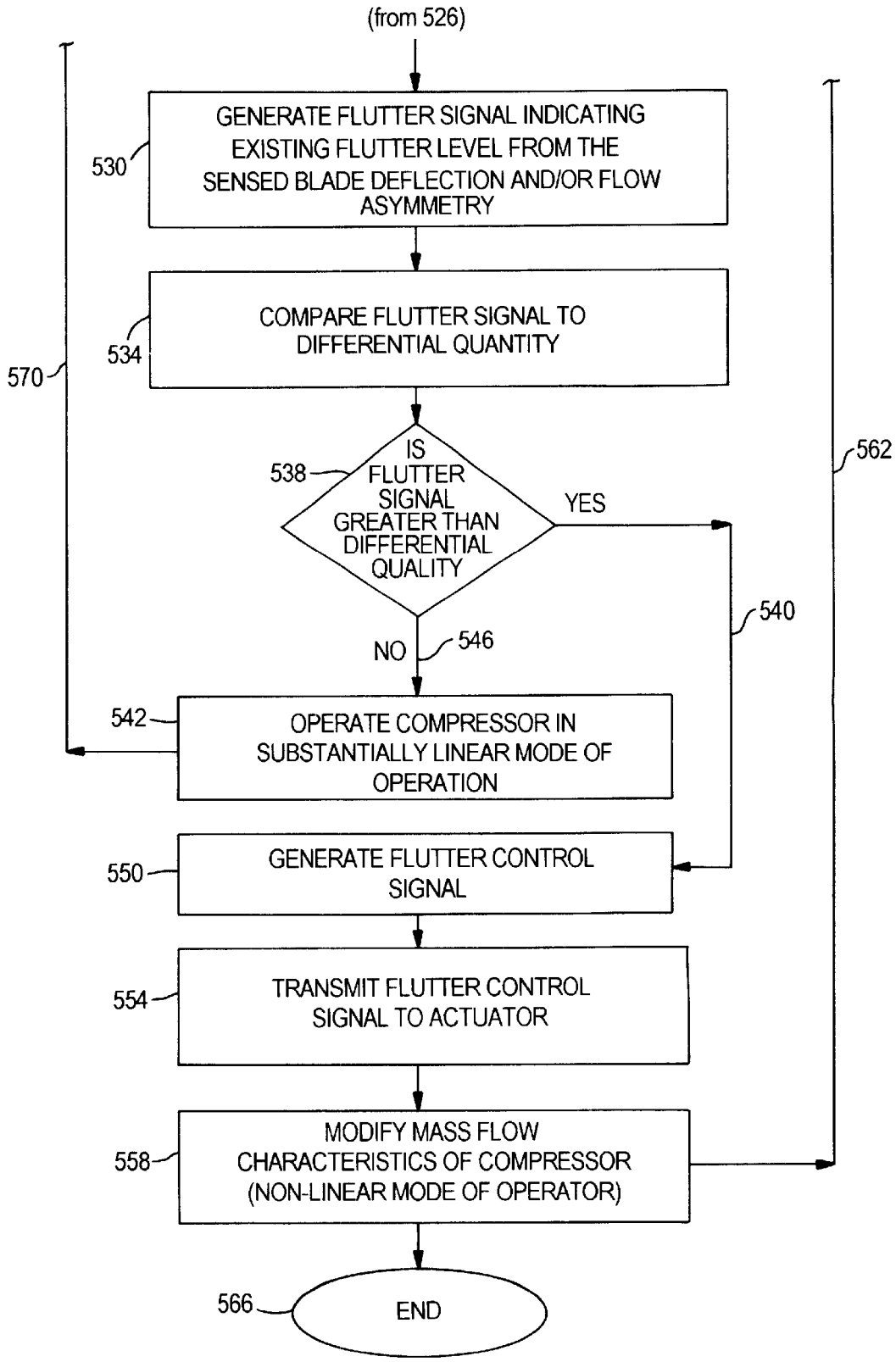

The operation of the instant invention is described in conjunction with FIGS. 2A and 2B, which are a flowchart 50 of steps to reduce flutter in a rotary compression system. As shown in FIG. 2A, block 502 starts the process. In block 504 data is generated that represents substantially optimum operating parameters for a rotary compressor. Block 508 shows that the operating parameters are stored in memory. This memory can be either in the vehicle computer or stored at a remote location that is accessed from the vehicle and downloaded to the vehicle. Thus, the actual location of the storage is not critical to the understanding of the invention.

Step 512 is the generation of data representing the flutter conditions of the rotary compressor. This data is indicative of flutter instability that can cause undesired and/or catastrophic damage to a rotary compressor blade. This data can be generated from known information, experimental information or projections based on experimental data and defines the flutter boundary region described previously. Step 516 shows that the flutter condition data is stored in memory. In step 520 the relationship of the optimum operating parameters and the flutter condition is used to generate a safety margin or differential quantity. The differential quantity represents an area of the map in which the compressor could experience detrimental flutter. In step 524 this differential quantity is stored in memory. Step 526 shows sensing blade deflection and/or flow asymmetry resulting from the blade deflection. As shown in step 530 FIG. 2B, a signal is generated indicating the magnitude of existing sensed flutter from the rotary blade of a compressor. In step 534 the magnitude of the flutter signal is compared to the differential quantity. Decision block 538 makes a determination of whether or not the magnitude of the present sensed flutter is greater than the differential quantity.

If the magnitude of the sensed flutter is less than the differential quantity, the instant invention commands the compressor to operate in a substantially linear mode of operation as shown in block 542 via line 546. This means that the sensed flutter is such that nearly optimum operating parameters will not intersect or experience flutter boundary condition effects. Line 570 shows the loop to step 526.

If the existing flutter is greater than the differential quantity, the instant invention will generate a flutter control signal as shown in step 550 via line 540. This is control signal is transmitted to one or more actuators as shown in step 554. The one or more actuators modify the mass flow characteristics of the compressor such that the compressor will operate in a substantially non-linear mode of operation as shown in step 558. This substantially non-linear mode of operation causes the compressor to vary from the optimum operating conditions and operate in a mode that avoids the flutter boundary layer. Line 562 illustrates the loop to step 526.

Once the sensors sense that the magnitude of the sensed flutter will not be detrimental to the compressor, the compressor can begin operating in a substantially linear mode of operation. The above described system suitably operates during operation of the compressor. End block 566 occurs when the compressor is shut down.

As can be seen by FIG. 2A and FIG. 2B, the instant invention enables a continuously monitoring flutter control system. This is advantageous because when flutter is not a concern, the compressor can operate along optimum operating conditions. When the compressor might encounter the flutter instability region on the performance map, the compressor will operate in a substantially non-linear or transient mode of operation and thereby avoid the flutter instability area on the performance map.

Figure 3:
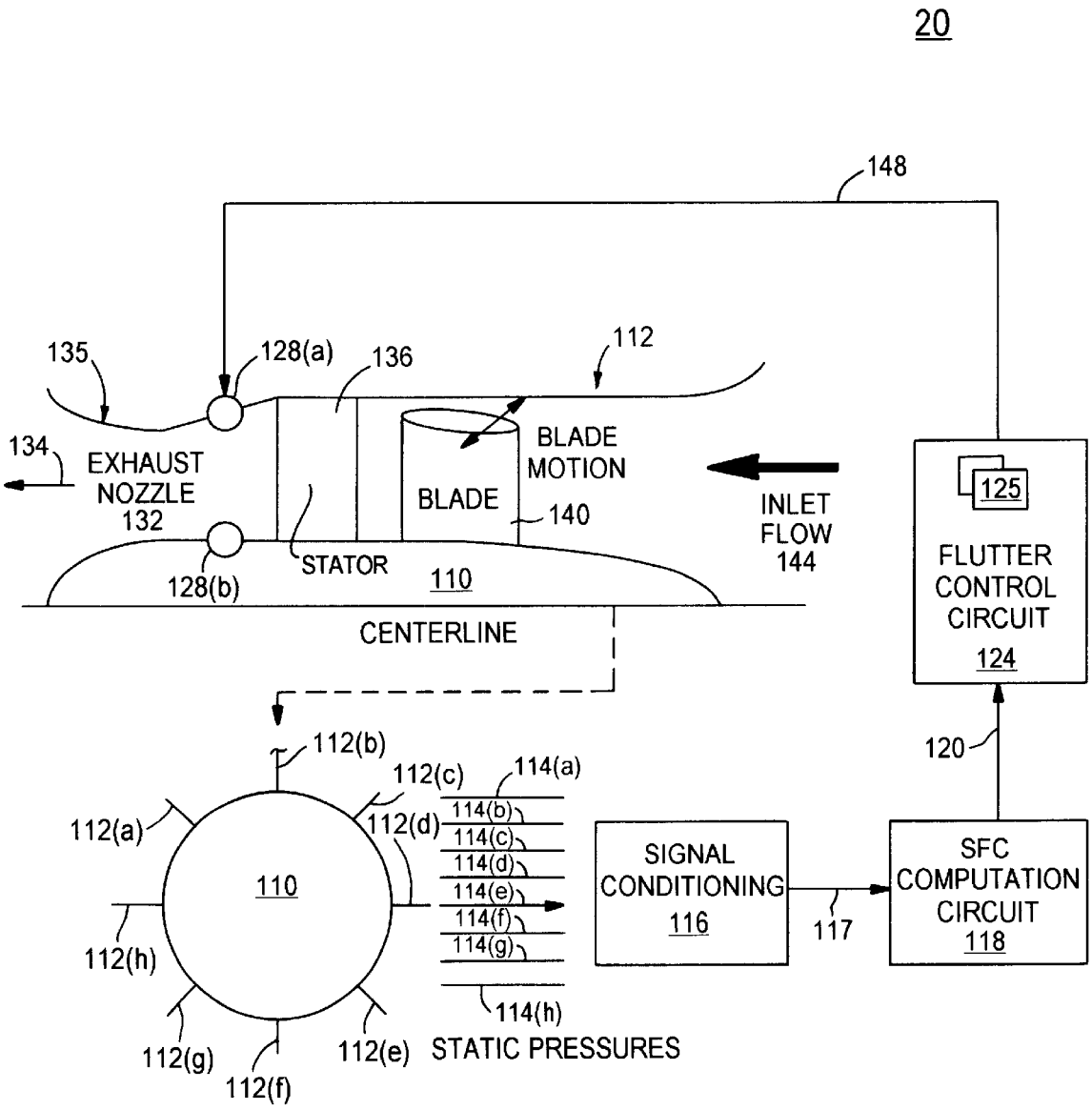
FIG. 3 shows a schematic of a flutter control system.

FIG. 3 shows system 20, that modifies the mode of operation of a rotary compressor 110, such as a gas turbine engine that can be used to provide lift and thrust for an aircraft by varying exhaust flow or outlet flow 134 from exhaust nozzle 132. One or more sensors shown as 112(*a*) . . . (*h*), where (h) represents any suitable number of pressure sensors are used to sense blade deflection and/or flow asymmetry. It is possible to use a single sensor, however, a plurality of pressure sensors 112 enable more precise sensing. The rotary compressor 110 typically has a plurality of compressor blades 140 (only one blade is illustrated, and the number of compressor blades is not critical to understanding the invention). These blades 140 are typically powered by a motor (not shown). The pressure sensors 112(*a*) . . . (*h*), referred to as 112 herein, are suitably mounted on an associated blade 140 to sense the motion of the blade 140 as the blade 140 interfaces with inlet fluid flow 144. Alternatively, the sensors may be located on the rotary compressor 110, either upsteam or downstream of the blade 140. The pressure sensors 112 may be total pressure sensors, static pressure sensors, strain gauge sensors, or any suitable sensor that can sense a pressure change on a surface or fluid flow asymmetry (fluid is typically air but could also be liquid).

The pressure sensors 112, which are suitably capable of measuring blade motion as well as flow asymmetry are typically a strain gauge sensor for measuring the disturbance properties (e.g. deformation and/or deflection) of a blade. The pressure sensors 112 may be mounted at any suitable location. Each pressure sensor 112 generates a corresponding blade strain signal 114(*a*) . . . (*h*) (collectively referred to as flutter signals 114) corresponding to the blade deformation movement sensed on the corresponding blade. Alternatively, the pressure sensors 112 may sense the flow asymmetry produced by blade movement. The asymmetric blade deflection will produce a corresponding asymmetrical fluid flow through the rotary compressor 110. These flutter signals 114 are transmitted to a signal conditioning circuit 116 and represent blade movement or flutter rate that produces flow asymmetry of outlet flow 134.

The signal conditioning circuit 116 processes the plurality of flutter signals 114(*a*) . . . (*h*) to generate a composite signal representing the sensed flutter also referred to as the flutter rate. The flutter rate is the asymmetry of either the blade motion or resulting fluid flow pattern that is a function of blade motion. The signal conditioning circuit 116 transmits the composite signals that represent the sensed flutter to SFC computation circuit 118 via inter-connector 117. Inter-connector 117 is suitably a wire or other means of transmitting a signal from signal conditioning circuit 116 to SFC computation circuit 118.

The SFC computation circuit 118 calculates a spatial Fourier coefficient (SFC), which provides a mathematical representation in the form of an amplitude of sensed flutter by pressure sensors 112. As well-known in the art, the amplitude of a sinusoidal wave form, alternatively referred to as an amplitude signal, can represent the amplitude of signals transmitted from pressure sensors 112. This amplitude may be calculated by spatially averaging the pressure sensor 112 inputs and determining a spatial root mean square (RMS) of the variation of the pressure sensor 112 outputs. The flutter signals 114(*a*) . . . (*h*) are used by the SFC computation circuit 118 to produce real-and imaginary values for the spatial Fourier coefficient (SFC). The flutter signals can be resolved into several Fourier coefficients, which identify the amplitudes of components associated with the sine and cosine patterns of harmonic wave forms. Suitably, the real and imaginary components for SFC computation circuit 118 are filtered and an error signal is generated as known to those skilled in the art and described in Patent Application WO 9700381, entitled "Compressor Stall and Surge Control Using Airflow Asymmetry Measurement". The SFC computation circuit 118 transmits the SFC signal and error signal to flutter control circuit 124 via inter-connector 120. Inter-connector 120 is suitably a wire.

The flutter control circuit 124 suitably includes a 48086 microprocessor or any processor with suitable memory and speed and has memory 125 for storing data. The flutter control circuit 124 generates a control signal to control operation of actuators 128 and/or 135.

The flutter control circuit suitably generates the control signal in one of two ways. The first way is to generate a control signal based on the received amplitude signal received from the SFC computation circuit 118. The amplitude signal is compared to a noise signal that is stored in memory 125 that represents normal asymmetry that is expected to be present in system 20.

The flutter control circuit 124 compares the amplitude signal to the noise signal and if the amplitude signal is less than the noise signal, the flutter control circuit 124 does not generate a control signal since there is not an appreciable level of flutter in system 20. If the amplitude signal level is greater than the noise level, the flutter control circuit 124 multiplies the amplitude signal by a pre-programmed scaling factor to produce a control signal. The pre-programmed scaling factor is a function of a mathematical relationship between the amount of flutter sensed and the amount of movement necessary by the actuator 128 to compensate for that amount of flutter.

Additionally, flutter control circuit 124 can also subtract the noise signal from the amplitude signal (provided the amplitude signal is greater than the noise signal) and multiply the difference by the scaling factor to produce the control signal.

A second manner in which the flutter control circuit 124 can generate a control signal is to store data on a computer readable medium. This data represents the flutter boundary line and optimal operating conditions and was discussed in relation to FIG. 1 and FIGS. 2A and 2B. The parameters of the flutter region and operating conditions can be stored in memory and reprogrammed and updated as conditions require. This enables the data stored in memory to accurately reflect the conditions (i.e., flutter boundary region and optimum conditions) of a particular compression system. Indeed, the data can reflect environmental conditions such as wind, temperature and ambient atmospheric pressure.

The flutter control circuit 124 will transmit a control signal via inter-connector 148 to an actuator 128 that will cause the actuator to change its position. The actuator 128 is suitably one or more bleed valves 128(*a*) and (*b*) (although only two bleed valves are shown, the number of bleed valves is strictly a design choice and is not critical to understanding the invention.) Alternatively, the actuator could be the wall of exhaust nozzle 132 shown as actuator 135. During operation of system 20, the actuators 128,135 will vary position to provide a modified exhaust channel for outlet flow 134. The operation of system 20 enables the pressure inlet fluid flow 144 exerts on blade 140 to be varied by modifying the outlet flow 134. By modifying the outlet flow 134, pressure on compressor blade 140 will be reduced.

Alternatively, the actuators may be continuously adjusted based on the sensed blade deflection and/or flow asymmetry by control signal from flutter control circuit 124. The pressure sensors 112 continually provide data to the flutter control circuit 124, allowing continuous monitoring of the operating characteristics of the system 20.

The cross sectional area of exhaust nozzle 132 can be modified by varying the distance between the side wall forming actuator 135. The actuator 135 is suitably controlled by the control signal from flutter control circuit 124. The modification of the exhaust nozzle configuration will modify air flowing to stator 136 from compressor blade 140. Modifying the exhaust flow through exhaust nozzle 132 will modify the pressure sensed by pressure sensors 112.

Actuators may also be one or more bleed valves shown as actuators 128. Opening a bleed valve decreases the back pressure on the rotary compressor 110 and thereby increases the inlet fluid flow 144 through the compressor 110. Normally the bleed valve actuator 128 will be closed and will only open when the level of asymmetry is above the noise floor. Other actuators are suitably a variable exit nozzle or valves which recirculate the flow of fluid from downstream to upstream of the rotary compressor 110. The major requirements of the actuator is that it must be capable of modulating the annulus averaged flow through the rotary compressor 110.

Figure 4:
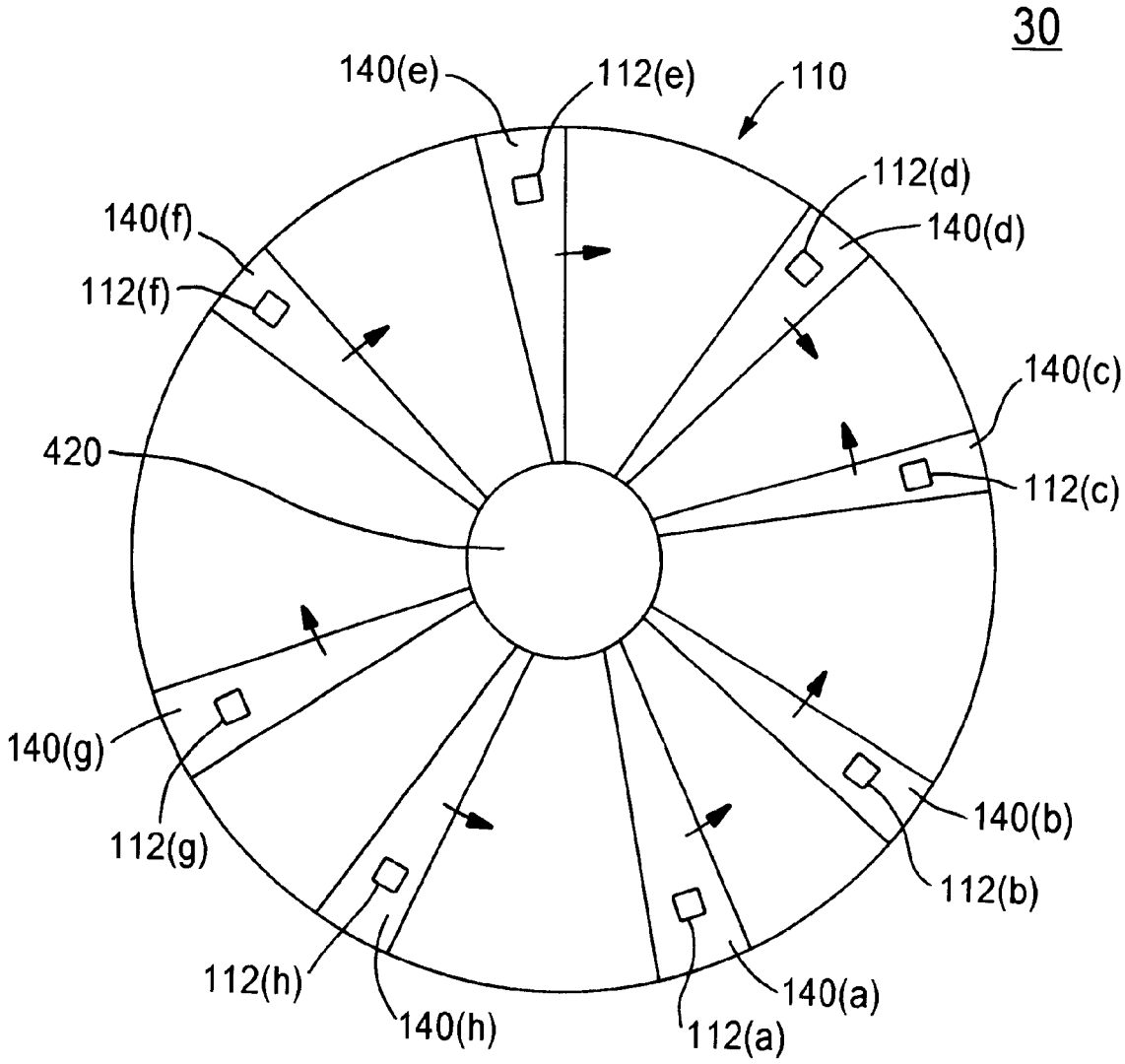
FIG. 4 shows a compressor with sensors mounted on the blades of the compressor.

FIG. 4 is a diagram of a rotary compressor 110 with a plurality of compressor blades 140(*a*) . . . (*h*), each of which has an associated pressure sensor 112(*a*) . . . (*h*) (described collectively as 112).

The pressure sensors 112 are suitably mounted on an associated compressor blade 140(*a*) . . . (*h*) of a rotary compressor 110 or alternatively, mounted to sense the flow asymmetry produced by the compressor blades 140(*a*) . . . (*h*). The compressor blades 140(*a*) . . . (*h*) are powered by an engine (not shown) and rotate at a particular frequency. The particular frequency is a natural frequency and can give rise to blade instability due to blade deflection and/or deformation while the blade is rotating.

The particular natural frequency for a blade is a function of the frequency of rotation. While a plurality of blades powered by a engine are rotating, opposing blades are completely out of phase. As shown in FIG. 4, compressor blade 140(*a*) is 180° out of phase with compressor blade 140(*e*) Similarly, blades 90° away from each other are 90° out of phase. Thus, compressor blade 140(*g*) is 90° out of phase with compressor blade 140(*e*).

For example, a blade having a rotor speed of 25 Hz could have a natural frequency of 60 Hz and will experience a first bending mode at 60 Hz. The sensors sense the bending of the blade and generate the blade strain signals representing flutter characteristics as described above. Each blade has a particular natural asymmetry based on the natural frequency of the blade. Thus, the rotary compressor 110 will have an expected asymmetry level based on the natural asymmetry of each compressor blade 140(*a*) . . . (*h*) of rotary compressor 110. This natural asymmetry is suitably used to generate an appropriate control signal discussed above.

Figure 5A:
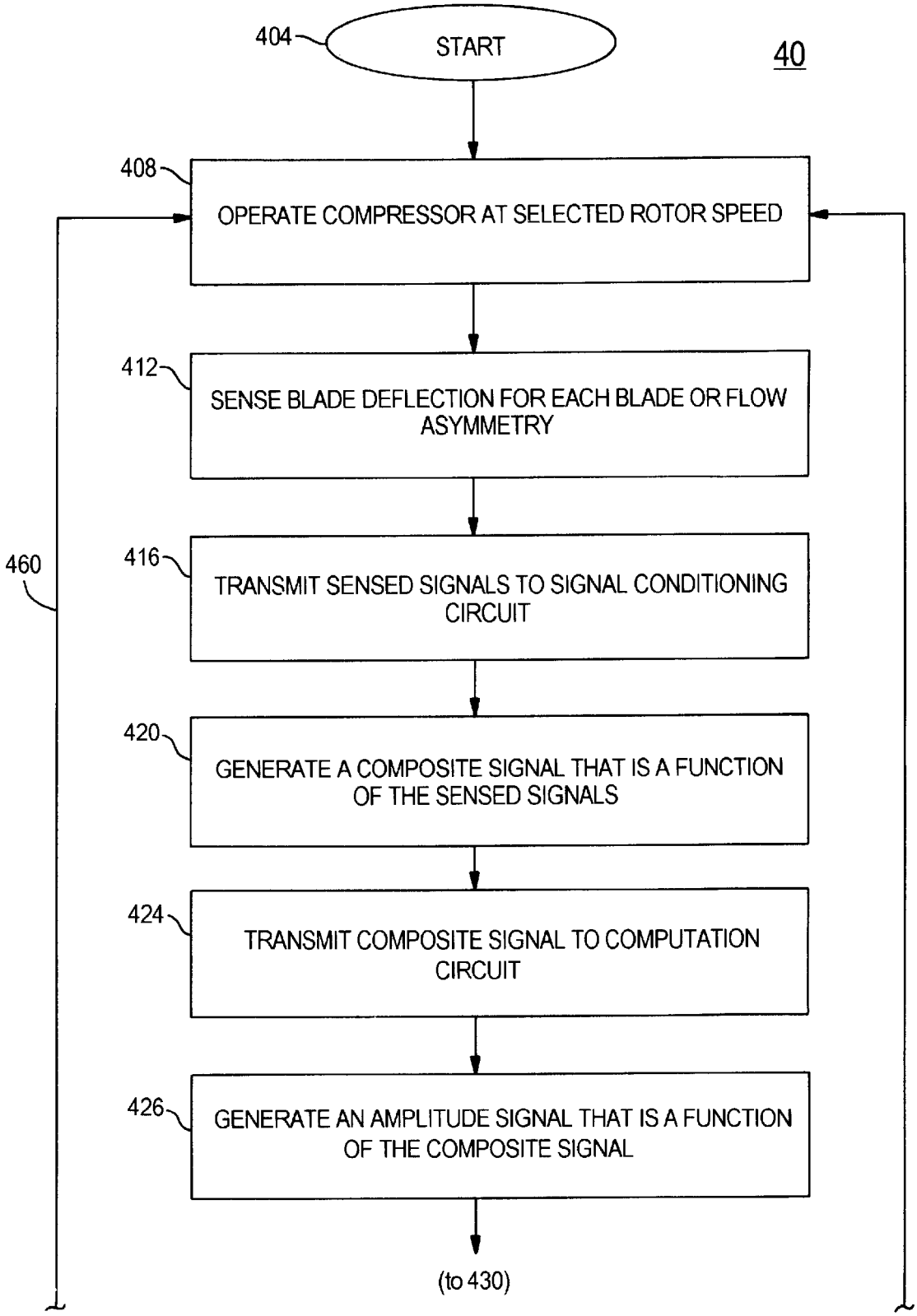
FIGS. 5A and 5B show a flow chart of the steps to control the effects of flutter in a compression system.
Figure 5B:
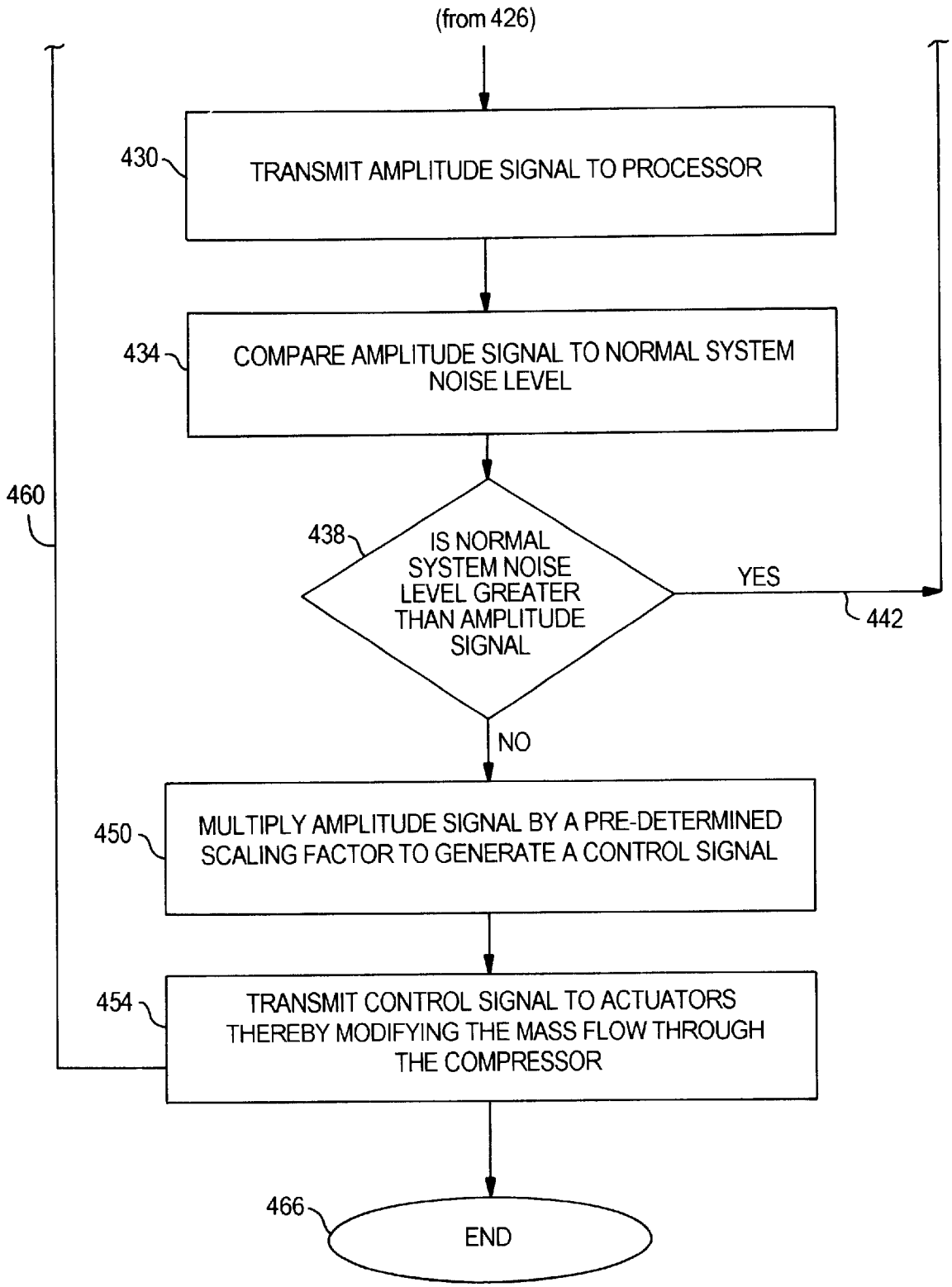

FIGS.5A and 5B are a flow chart 40 illustrating steps to reduce flutter characteristics in a rotary compressor. As shown in FIG. 4A following the start box 404 in step 408 the compressor is operated at a selected rotor speed. This rotor speed is determined by the engine controls, for example, of an aircraft. In step 412 the deflection and/or deformation for each blade is sensed by a sensor such as a strain-gauge sensor. It is also possible to sense flow asymmetry that results from blade deflection or deformation. In either situation the result is sensing the flutter. In step 416 the sensors transmit the sensed flutter signals to a signal conditioning circuit. In step 420 the signal conditioning circuit generates a composite signal that is a function of the sensed flutter signals. In step 424 the composite signal is transmitted to a computation circuit. In step 426, the computation circuit generates an amplitude signal based on the composite signal received from the signal conditioning circuit in FIG. 4B. Step 430 shows that the amplitude signals are transmitted to a processor, such as the flutter control circuit described above. Step 434 shows that the processor compares the amplitude signal to normal system noise that is present in rotor compression systems. Block 438 is a decision block in which the result of the comparison of the amplitude signal to the normal noise level is determined. The normal noise level is asymmetry in the flow rate that is expected and does not require compensation. If the normal noise level is greater than the amplitude signal, the processor or flutter control circuit does not generate a command to the actuators. Rather, the processor or flutter control circuit will await another amplitude signal from the computation circuit that is based on future sensed blade deflection or flow asymmetry, this is shown as line 442 in FIGS. 5A and 5B. However, if the normal system noise is less than the amplitude signal the processor will generate a control signal by multiplying the amplitude signal by a predetermined scaling factor as shown in block 450. This scaling factor is function of rotary compressor design and operating characteristics. The scaling factor depends on the operating parameters and is specific to each compressor. The scaling factor is typically stored in memory either in the processor or coupled to the processor. Block 454 shows the transmission of the control signal that is generated by the processor to actuators. This control signal causes the actuators to respond and thereby modify the mass flow through the compressor. This system will continue to monitor the sensed flutter based on the compressor operation until the compressor is no longer operating. This continual monitoring is shown by line 460 that returns to operation block 408. Termination of compressor operation is achieved by exiting from block 454 to block 466. Thus, the system disclosed in the instant invention enables continuous monitoring and control of actuators based on sensed flutter in a rotary compressor system.

Alternatively, the flutter control circuit can generate a control signal and compare the control signal to a system noise level. (This noise level is expected blade deflection or flow asymmetry that does not require compensation.) If the control signal is less than the system noise level, the actuators will not be commanded to change position. When the control signal exceeds the system noise level, the actuator will be commanded to modify their position. In this situation, the noise level is suitably subtracted from the control signal.

The flowchart described in FIGS. 5A and 5B is suitably stored on a computer-readable medium such as a floppy diskette, ROM or on the hard drive of a vehicle computer. Additionally, the program can be downloaded to a vehicle from a remote location.

While the invention has been described above with reference to specific embodiments thereof, it is apparent that many changes, modifications and variations can be made therein. Accordingly, it is intended to embrace all such changes, modifications and variations that fall within the spirit and broad scope of the appended claims. All of the above-noted patents, patent applications and publications referred to in this application are incorporated herein by reference in their entireties.

What is claimed is:

1. A system for reducing flutter instability in a rotary compressor having a plurality of blades comprising:

a plurality of sensors for sensing vibrations resulting from deformation movement of the blade and generating a flutter signal that is a function of the vibrations;

a signal conditioning circuit, coupled to each of the sensors for receiving the flutter signals and processing the flutter signals to produce a composite signal that is a function of the flutter signals;

a computation circuit, coupled to the signal conditioning circuit, for receiving the composite signal and generating an amplitude signal that is a function of the composite signal;

a flutter control circuit, coupled to the computation circuit, for receiving the amplitude signal and generating a control signal that is a function of the amplitude signal;

an actuator, coupled to the flutter control circuit, for receiving the control signal and responding to the control signal by modulating an annulus averaged flow through the compressor thereby reducing flutter characteristics on the plurality of blades.

2. The system of claim 1 wherein each sensor is mounted on an associated blade.

3. The system as claimed in claim 2 wherein the flutter signal is a function of vibrations representing blade strain.

4. The system as claimed in claim 1 further comprising:

a memory, coupled to the flutter control circuit, for storing a scaling factor and transmitting the scaling factor to the flutter control circuit;

wherein the flutter control circuit utilizes the scaling factor to generate the control signal.

5. The system as claimed in claim 4 wherein the amplitude signal corresponds to the first spatial Fourier coefficient for the control signal.

6. The system of claim 5 wherein the actuator does not change position when the control signal is less than a noise floor magnitude.

7. The system of claim 4 wherein the sensors are selected from the group consisting of strain gauges, total pressure sensors, and static pressure sensors.

8. The system of claim 7 wherein the at least one actuator is selected from the group consisting of bleed valves and variable exit nozzles; and the actuator is capable of increasing mass flow through the compressor.

9. The system of claim 7 wherein the one or more sensors sense normal system noise and the flutter control circuit utilizes the noise signal to generate the control signal.

10. The system of claim 4 wherein the rotary compressor is mounted on an aircraft.

11. A method for reducing flutter instabilities in a rotary compression system comprising:

sensing vibration produced by a rotating blade;

generating a flutter signal that is a function of the sensed vibration;

transmitting the flutter signal to a processor;

generating a control signal based on the flutter signal;

transmitting the control signal to an actuator for controlling the position of the actuator, thereby modulating an annulus averaged flow through the compressor;

generating a noise signal indicative of expected flutter;

comparing the flutter signal to the noise signal; and generating the control signal based on the comparison.

12. The method of claim 11 further comprising:

sensing the vibration by sensing blade strain on one or more blades of the rotary compressor.

13. A method for reducing flutter instabilities in a rotary compression system comprising:

sensing vibration produced by a rotating blade;

generating a flutter signal that is a function of the sensed vibration;

transmitting the flutter signal to a processor;

generating a control signal based on the flutter signal;

transmitting the control signal to an actuator for controlling the position of the actuator, thereby modulating an annulus averaged flow through the compressor;

generating a scaling factor, that is a function of compressor design;

storing the scaling factor in memory; and utilizing the scaling factor to generate the control signal.

14. A method for reducing instability of a rotary compressor, said method stored on a computer-readable medium and comprising:

generating a substantially parabolic flutter boundary curve representing flutter parameters of the rotary compressor;

operating the rotary compressor in a substantially linear mode of operation that is in accordance with substantially optimum operating parameters of the rotary compressor;

sensing flutter vibrations of the compressor;

calculating a differential quantity representative of the difference between the flutter boundary curve and the operating mode;

comparing the flutter vibrations to the differential quantity;

operating the rotary compressor in a substantially non-linear mode of operation when the magnitude of the flutter vibration equals or exceeds than the differential quantity;

monitoring the relationship of the magnitude of the flutter vibration and the differential quantity; and operating the rotary compressor in the substantially linear mode of operation when the flutter vibration is less than the differential quantity.

15. The method of claim 14 wherein the flutter vibration is a function of blade motion.

16. The method of claim 15 wherein the substantially non-linear mode of operation comprises:

generating a control signal corresponding to sensed flutter; and controlling an actuator in response to the control signal;

whereby the actuator modifies the quantity of mass flow through the rotary compressor.

* * * * *